US008104586B2

(12) United States Patent
Traktovenko et al.

(10) Patent No.: US 8,104,586 B2
(45) Date of Patent: Jan. 31, 2012

(54) ELEVATOR MOTOR BRAKE TORQUE MEASUREMENT DEVICE

(75) Inventors: Boris Traktovenko, Avon, CT (US); Robin Mihekun Miller, Canton, CT (US); James L. Hubbard, III, Kensington, CT (US)

(73) Assignee: Otis Elevator Company, Farmington, CT (US)

( * ) Notice: Subject to any disclaimer, the term of this patent is extended or adjusted under 35 U.S.C. 154(b) by 1211 days.

(21) Appl. No.: 11/815,694

(22) PCT Filed: Feb. 25, 2005

(86) PCT No.: PCT/US2005/006265

§ 371 (c)(1),
(2), (4) Date: Aug. 7, 2007

(87) PCT Pub. No.: WO2006/093487

PCT Pub. Date: Sep. 8, 2006

(65) Prior Publication Data

US 2009/0120728 A1 May 14, 2009

(51) Int. Cl.
*B66B 1/34* (2006.01)

(52) U.S. Cl. ..... 187/391; 187/277; 187/289

(58) Field of Classification Search ..... 187/277, 187/289, 391

See application file for complete search history.

(56) References Cited

U.S. PATENT DOCUMENTS 3,323,606 A * 6/1967 Bruns et al. ..... 177/147
3,610,342 A 10/1971 Stainken
3,830,344 A * 8/1974 Cervenec et al. ..... 188/171
4,306,637 A * 12/1981 Keiser et al. ..... 188/170
4,602,702 A 7/1986 Ohta et al.
4,623,044 A 11/1986 Ohta et al.
4,766,977 A * 8/1988 Yamasaki ..... 187/392
4,854,424 A 8/1989 Yamatoh et al.
5,090,518 A 2/1992 Schenk et al.
5,156,239 A 10/1992 Ericson et al.
5,233,139 A 8/1993 Hofmann
5,645,143 A 7/1997 Mohr et al.

(Continued)

FOREIGN PATENT DOCUMENTS

CN 1343878 4/2002

(Continued)

OTHER PUBLICATIONS

Supplementary European Search Report dated Nov. 3, 2010.

*Primary Examiner* — Walter Benson
*Assistant Examiner* — Kawing Chan
(74) *Attorney, Agent, or Firm* — Carlson, Gaskey & Olds, P.C.

(57) ABSTRACT

An elevator machine (20) assembly useful in an elevator system (10) includes a motor frame (26) that supports a motor (24) for selectively rotating a motor shaft (28). A brake (36) selectively applies a braking force to resist rotation of the motor shaft (28). At least one load sensor (46) resists undesirable movement of the brake (36) and provides an indication of a load that results from applying the braking force. A disclosed example includes using a first resistive member (46) to resist movement of the brake (36) relative to the motor frame (26) when the load is below a threshold load and using a second resistive member (60) to resist movement when the load exceeds the threshold load.

22 Claims, 3 Drawing Sheets

U.S. PATENT DOCUMENTS

| | | | | |
|---|---|---|---|---|
| 5,751,126 | A | 5/1998 | Hellinger et al. | |
| 6,053,287 | A | 4/2000 | Weinberger et al. | |
| 6,305,503 | B1 * | 10/2001 | Suzuki et al. | 187/393 |
| 6,401,873 | B1 | 6/2002 | Mustalahti et al. | |
| 6,483,047 | B1 | 11/2002 | Zaharia et al. | |
| 6,488,128 | B1 * | 12/2002 | Slabinski | 187/393 |
| 2002/0100646 | A1 | 8/2002 | Maurice et al. | |
| 2006/0151254 | A1 * | 7/2006 | Sevilleja-Perez et al. | 187/351 |

FOREIGN PATENT DOCUMENTS

| | | | | |
|---|---|---|---|---|
| EP | 1314675 | | | 5/2003 |
| JP | 60081527 | | | 5/1985 |
| JP | 60139927 | A | | 7/1985 |
| JP | 62-56277 | | | 6/1987 |
| JP | 2-43191 | | | 2/1990 |
| JP | 09110324 | A | * | 4/1997 |
| JP | 2008076161 | A | * | 4/2008 |
| SU | 512401 | | | 4/1976 |
| SU | 899449 | | | 1/1982 |
| WO | WO02/055898 | A1 | | 7/2002 |
| WO | WO 03062115 | A1 | * | 7/2003 |
| WO | 2004058618 | | | 7/2004 |

* cited by examiner

ELEVATOR MOTOR BRAKE TORQUE MEASUREMENT DEVICE

FIELD OF THE INVENTION

This invention generally relates to elevator brakes and, more particularly to elevator machine brakes that include a load sensor for indicating a load on an elevator machine brake.

BACKGROUND OF THE INVENTION

Elevator systems are widely known and used. Typical arrangements include an elevator cab that moves between landings in a building, for example, to transport passengers or cargo between different building levels. A motorized elevator machine moves a rope or belt assembly, which typically supports the weight of the cab, and moves the cab through a hoistway.

The elevator machine includes a machine shaft that is selectively rotationally driven by a motor. The machine shaft typically supports a sheave that rotates with the machine shaft. The ropes or belts are tracked through the sheave such that the elevator machine rotates the sheave in one direction to lower the cab and rotates the sheave in the opposite direction to raise the cab. The elevator machine also includes a brake that engages a disk or a flange that rotates with the machine shaft to hold the machine shaft and sheave stationary when the cab is at a selected landing.

Typical elevator systems include a controller that collects cab weight information and controls the elevator machine based upon the weight information. The controller typically receives the weight information from load-measuring devices installed in the floor of the car. Disadvantageously, floor-installed load-measuring devices often do not provide accurate enough weight information. When the weight in the cab is small, for example, floor-installed load-measuring devices may not accurately distinguish between the background weight of the cab and the small load. Also a load not centered in the cab will not give accurate weight information. Additional load-measuring devices may be used to increase the accuracy, however, the expense and maintenance of the elevator system increases with each additional device. Changes to the elevator such as counterweight loads or modifications to the car are not accounted for by the floor sensors.

Other elevator systems utilize the elevator brake to indicate the weight on the car. Typically, these systems utilize a load cell leveraged between the brake and the floor of the elevator machine room. The torque resulting from application of the brake results in a load on the load cell. Disadvantageously, these systems require a large amount of space in the elevator machine room, are inaccurate by the brake or machine weight added to the load cell amount, and may be expensive. Elevator brakes and load cells in this type of configuration may also cease to operate properly under high levels of torque, which may lead to undesirable conditions in the elevator system. One proposed solution includes making the load cells larger and more robust, however, this may lead to a loss of sensitivity in indicating the weight in the cab.

There is a need for a strong, compact, and sensitive system for providing elevator cab weight information. This invention addresses those needs and provides enhanced capabilities while avoiding the shortcomings and drawbacks of the prior art.

SUMMARY OF THE INVENTION

An exemplary elevator machine assembly useful in an elevator system includes a motor frame that supports a motor for selectively rotating a motor shaft. A brake selectively applies a braking force to resist rotation of the motor shaft. At least one load sensor resists movement of the brake relative to the motor frame. The load sensor provides an indication of a load that results from applying the braking force, which is indicative of the imbalance weight of an associated elevator cab in relation to a counterweight.

In another example, the elevator machine assembly includes a first member that resists movement of a braking member relative to a rigid member for a load between the braking member and the rigid member that is below a threshold operating load of the first member. A second member resists movement if the load exceeds the threshold operating load.

In one example, the first member is a load cell.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
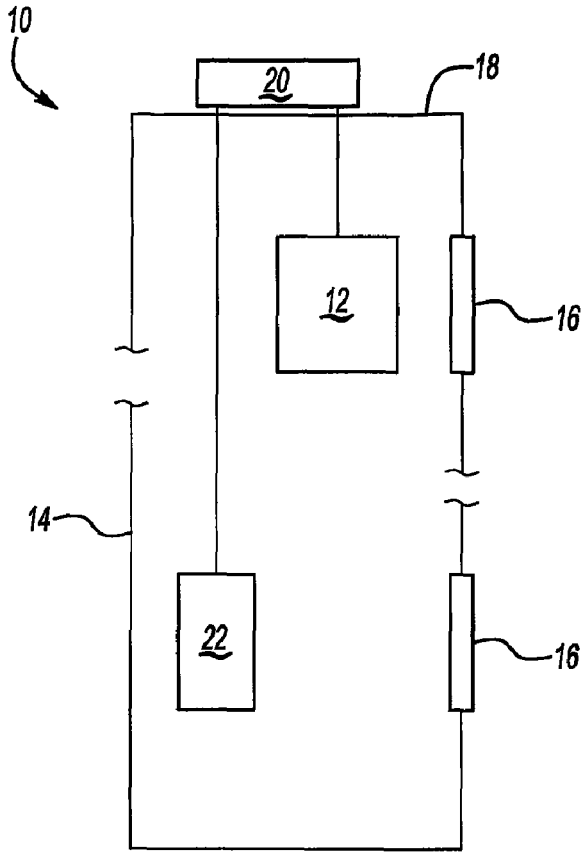
FIG. 1 schematically shows selected portions of an example elevator system.

FIG. 1 shows selected portions of an example elevator system 10 that include an elevator cab 12 that moves in a hoistway 14 between landings 16 of a building. In the example shown, a platform 18 above the elevator cab 12 supports an elevator machine 20. The elevator machine 20 moves the cab 12 and a counterweight 22 in a generally known manner up and down in the hoistway 14 to transport cargo, passengers or both.

Figure 2:
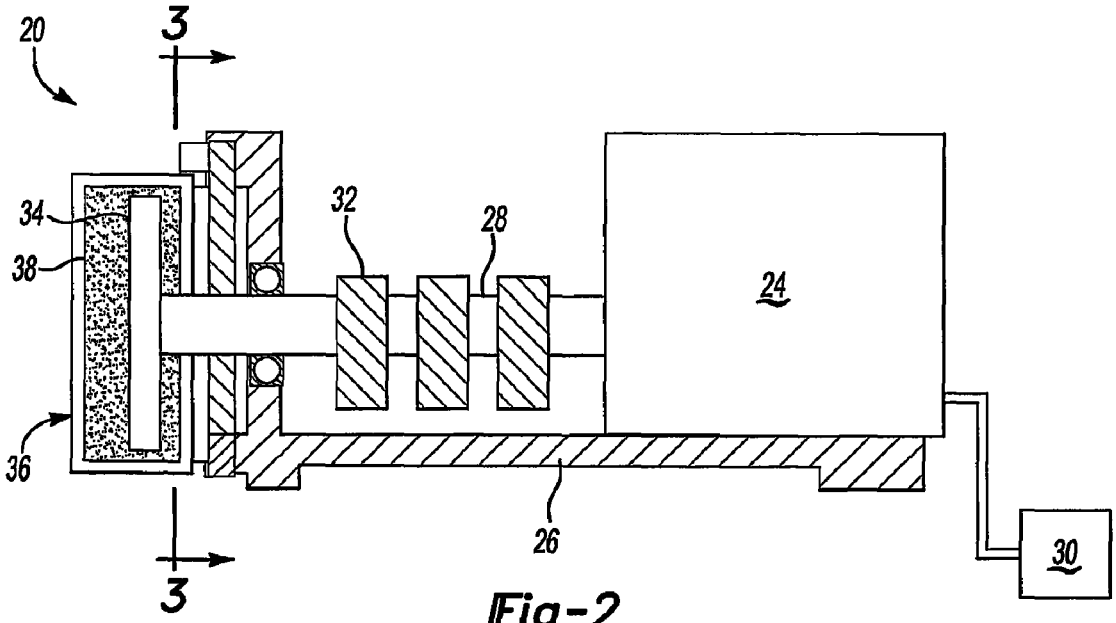
FIG. 2 schematically shows a cross-sectional view of selected portions of an example elevator machine.

FIG. 2 shows a cross-sectional view of selected portions of an example elevator machine 20 that includes a motor 24 supported by a motor frame 26. The motor 24 selectively drives a shaft 28 in response to signals from a controller 30. Rotation of the shaft 28 moves traction sheaves 32, which move ropes or belts to move the elevator cab 12 and counterweight 22 in the hoistway 14 as known.

The example shaft 28 includes a disk 34 within a brake 36. A brake-applying portion 38 of the brake 36 selectively applies a braking force to the disk 34 to resist rotation of the shaft 28. In one example, the controller 30 commands the brake-applying portion 38 to apply a braking force to hold the elevator cab 12 at a selected building landing 16 or to slow the movement of the elevator cab 12.

Figure 3:
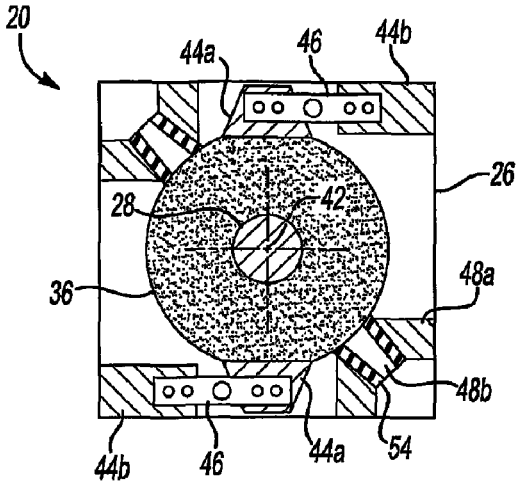
FIG. 3 schematically shows a view of the example elevator machine of FIG. 2 corresponding to a cross-sectional view taken along the lines 3-3.

FIG. 3 corresponds to a cross-sectional view down a longitudinal axis 42 of the shaft 28 of selected portions of the example elevator machine 20 of FIG. 2. The brake 36 includes mounting bosses 44*a* that each support one end of a load sensor 46. In one example, the load sensors 46 include a tension-compression load cell that is capable of indicating both tensile loads and compressive loads. In other examples, the load sensors 46 may include other known types of sensors such as potentiometers, proximity sensors, optical sensors, or piezoelectric material, for example.

The motor frame 26 includes corresponding mounting bosses 44*b* that each support an opposite end of a corresponding load sensor 46. In the illustrated example, the load sensors 46 are secured to the mounting bosses 44*a* and 44*b* using fasteners, although other methods of attachment may alternatively be used.

Application of a braking force on the disk 34 results in a load between the brake 36 and the motor frame 26. The load is indicative of the difference in weight between the elevator cab 12 and the counterweight 22 (i.e. the weight of the cargo, passengers, etc. in the elevator cab 12). The difference in weight urges relative rotational movement (i.e., torque) about the axis 42 between the brake 36 and the motor frame 26. The load sensors 46 resist this movement and provide an indication of the load to the controller 30, for example.

These features may provide the benefits of detecting drag on the brake 36 and eliminating brake sensors (e.g. microswitches and proximity sensors) used in previously known assemblies. Drag on the brake 36 occurs if the brake-applying portion 38 fails to fully remove the braking force from the disk 34. In previously known assemblies, the brake sensors would detect whether the braking force was removed and provide feedback to the controller 30. The load sensors 46 replace this function by indicating the load between the brake 36 and the motor frame 26.

In the example shown, corresponding points on the load sensors 46 (for example, the points of attachment to the mounting boss 44*a*) are located approximately 180° circumferentially from each other with regard to the axis 42. In one example, this provides the advantage of a balanced resistance to movement about the shaft 28 and maintains or increases sensitivity in indicating the load.

The motor frame 26 and brake 36 include corresponding locking members 48*a* and 48*b*, respectively, that resist movement between the brake 36 and the motor frame 26 if the load exceeds a threshold operating load of the load sensors 46. One example threshold operating load is a load that would cause at least one of the load sensors 46 to detach from either of the mounting bosses 44*a* or 44*b* or to otherwise fail to continue resisting relative rotational movement between the brake and the motor housing. The locking members 48*a* and 48*b* are spaced apart a nominal distance such that the brake 36 can move relative to the motor frame 26 an amount corresponding to the nominal distance before the locking members 48*a* and 48*b* cooperate to resist movement. This feature allows the load sensors 46 to bear the load under normal circumstances and facilitates maintaining or increasing the sensitivity of the load sensors 46 by reducing or eliminating any load-absorbing interference between the locking members 48*a* and 48*b* when the load is below the threshold operating load.

In the example shown, the locking member 48*b* is a brake lock member that is positioned between two motor frame lock members 48*a*. If the load exceeds the threshold operating load of the load sensors 46, the brake 36 may approach a load limit of the load sensors. Upon rotating an amount corresponding to the nominal distance between the locking members 48*a* and 48*b*, the brake lock members 48*b* engage a corresponding one of the motor frame lock members 48*a* to resist further movement of the brake 36. This feature may provide the benefit of allowing use of smaller, less robust, and more accurate load sensors 46 compared to previously known assemblies because the load sensors 46 need not be designed to resist loads exceeding the threshold load.

The illustrated example includes a resilient cushion material 54 at least partially between the locking members 48*a* and 48*b*. The resilient cushion material 54 at least partially absorbs the load when the locking members 48*a* and 48*b* cooperate to resist the relative rotational movement between the brake 36 and motor frame 26. This feature may provide the benefit of reducing noise when the locking members cooperate.

Figure 4:
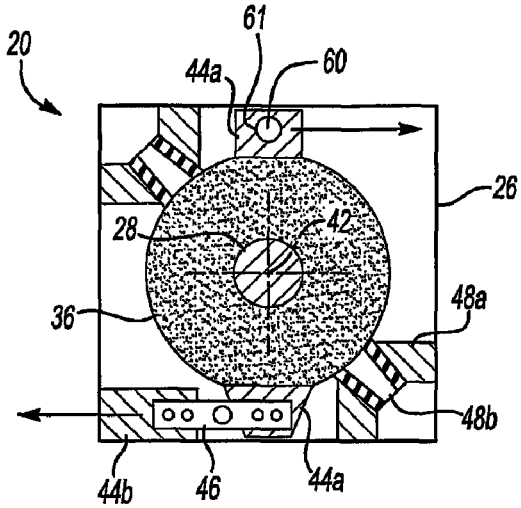
FIG. 4 schematically shows a view of selected portions of another embodiment of an example elevator machine.

FIG. 4 shows selected portions of another example elevator machine 20 including a reaction member, resistive member 60, that cooperates with a single load sensor 46 to resist movement during a brake application. In the example shown, the resistive member 60 includes a rod that is received through an opening 61 in one of the brake-mounting bosses 44*a* and a portion of the motor frame 26, although it should be recognized that other types of resistive members 60 in other arrangements may be used.

The opening 61 and the portion of the motor frame 26 that receives the resistive member 60 include an inner diameter that allows easy rotational motion in relation to the outer diameter of the resistive member 60 such that the brake 36 is permitted to move a limited amount relative to the motor frame 26. When the brake 36 applies a braking force to the shaft 28, the resulting load between the brake 36 and the motor frame 26 urges the brake 36 to rotate relative to the motor frame 26. The rod and load sensor 46 provide a balancing of this load about the axis 42 to prevent large-scale radial movement (i.e., non-rotational) of the brake 36 relative to the motor frame 26 (but allowing rotational movement of the brake 36). The slight movement permits the load to transfer, or react, from the rod to the load sensor 46. Large-scale movement, which would otherwise prevent the load from transferring to the load sensor 46, is prevented. The rod therefore provides dual functions of stabilizing the brake 36 with respect to the acting load and transferring the load to the load sensor 46. The resistive member 60 may provide the advantage of a less expensive system compared to a system with a plurality of load sensors, shown in FIG. 3, for example.

Figure 5:
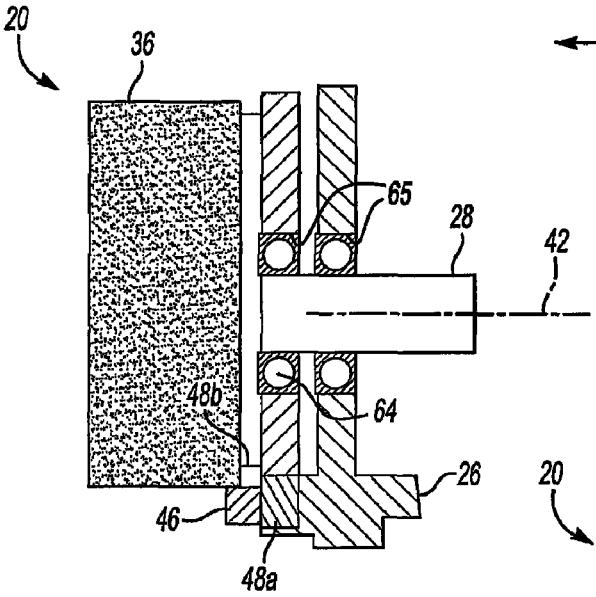
FIG. 5 schematically shows a partial cross-sectional view of selected portions of another embodiment of an example elevator machine.

FIG. 5 shows selected portions of another example elevator machine 20 that includes a bearing resistive member 64 that extends circumferentially around a portion of the shaft 28. The bearing resistive member 64 includes an inner and outer diameter and is received in a corresponding opening 65 in the brake 36 and motor frame 26. The outer diameter of the bearing resistive member 64 is slightly smaller than the inner diameter of the opening 65 such that the brake 26 is permitted to move slightly relative to the motor frame 36. Similar to the rod resistive member 60 in the example of FIG. 4, the bearing restrictive member 64 cooperates with a single load sensor 46 to balance the resulting load between the brake 36 and motor frame 26 to prevent large-scale radial movement (i.e., non-rotational) of the brake 36 relative to the motor frame 26.

Figure 6:
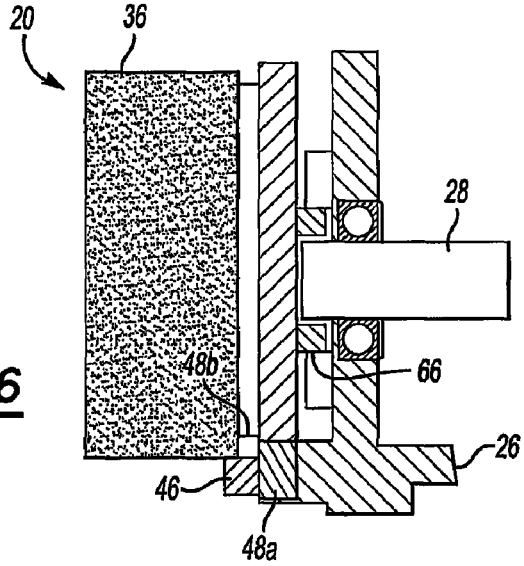
FIG. 6 schematically shows a partial cross-sectional view of selected portions of another embodiment of an example elevator machine.

FIG. 6 shows selected portions of another example elevator machine 20 that includes a sleeve bushing resistive member 66. Similar to the bearing resistive member 64, the sleeve bushing resistive member 66 and load sensor 46 cooperate to balance the resulting load between the brake 36 and motor frame 26 to prevent large-scale radial movement of the brake 36 relative to the motor frame 26 (but allowing slight movement).

Figure 7:
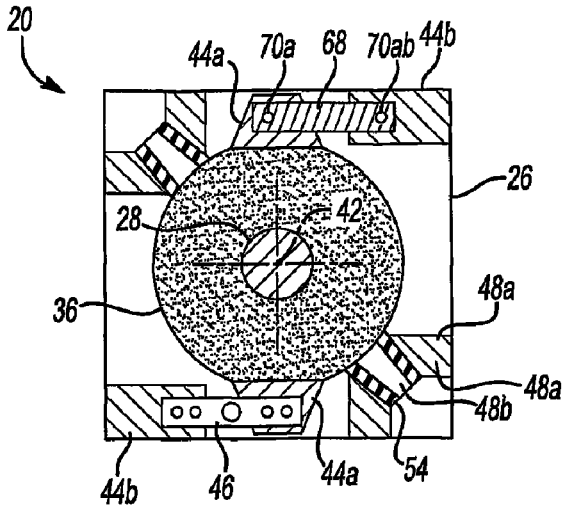
FIG. 7 schematically shows selected portions of another embodiment of an example elevator machine.

FIG. 7 shows selected portions of another example elevator machine 20, similar to the example shown in FIG. 3, that includes a metal spacer 68 instead of one of the load sensors 46. Similar to the bearing, rod, and sleeve examples, the metal spacer 68 and load sensor 46 provide a balancing of the resulting load between the brake 36 and motor frame 26 to prevent large-scale radial movement of the brake 36 relative to the motor frame 26 (but allowing slight movement). The metal spacer 68 includes one end that is attached to the brake mounting boss 44*a* and a distal end that is attached to the motor frame mounting boss 44*b* using respective fasteners 70*a* and 70*b*. The fasteners 70*a* and 70*b* in this example do not provide a rigid attachment and permit slight movement of the brake 36 relative to the motor frame 26 such that the load sensor 46 can react to the load and provide an indication of it.

Figure 8:
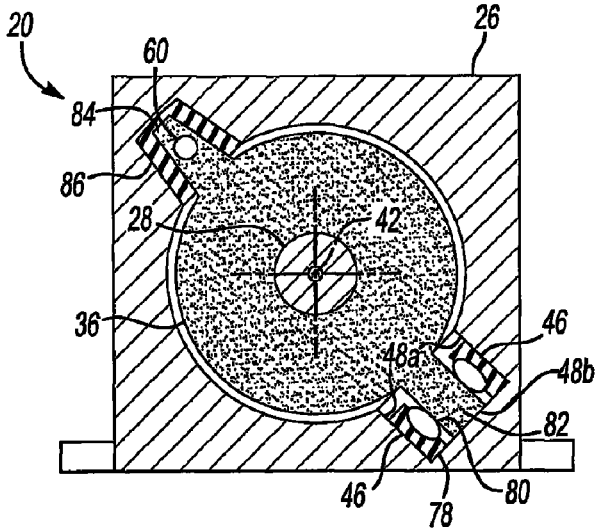
FIG. 8 schematically shows selected portions of another embodiment of an example elevator machine.

FIG. 8 shows selected portions of another example elevator machine 20 that includes compressive load sensors 46, for example compressive load cells. Each of the compressive load sensors 46 shown includes a base portion 78 and an input portion 80. In the example shown, the base portion 78 is mounted facing the motor frame 26 with the input portion 80 facing a brake extension member 82. When the brake 36 applies a braking force to the shaft 28, the compressive load sensors 46 indicate a load between the brake extension member 82 and the motor frame 26 resulting from the tendency of the brake to rotate relative to the motor frame 26. In one example, one of the compressive load sensors 46 indicates the load when the brake resists movement of the shaft in one direction, and the other of the compressive load sensors 46 indicates the load when the brake resists movement of the shaft in the other direction.

If the load exceeds a threshold load of the compressive load sensors 46, the brake extension member 82 acts as the brake lock member 48 and cooperates with the motor from lock member 48*a* to resist further movement of the brake 36, as described above.

In the example shown, the brake 36 also includes a second brake extension member 84 located oppositely from the brake extension member 82. In the illustrated example, the second brake extension member 84 is associated with a resistive member 60. This resistive member could be replaced with a retaining member and a resilient material 86 could be used instead. The cushion material 86 includes a stiffness that is lower than the stiffness of the compressive load sensors 46 such that only a small fraction of the load is absorbed by the resilient cushion material 86. This example includes the benefit of increased sensitivity of the compressive load sensors 46 because only a minimal fraction of the load may be lost through absorption by the resilient cushion material 86 and the resistive member 60.

Figure 9:
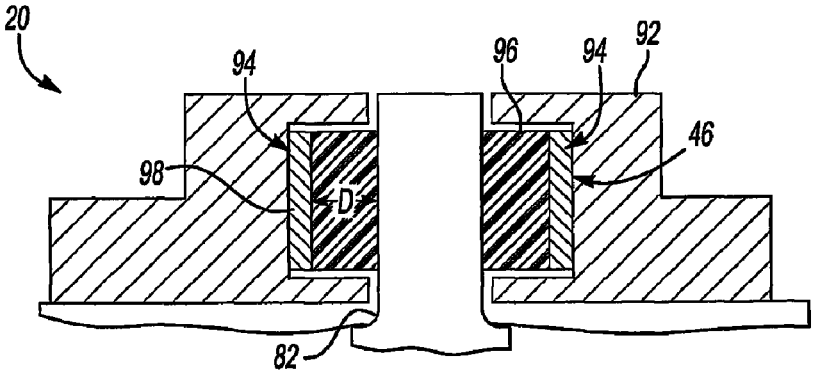
FIG. 9 schematically shows a partial cross-sectional view of selected portions of another embodiment of an example elevator machine.

FIG. 9 shows a partial cross-sectional view of selected portions of another example elevator machine 20 that includes a rigid housing 92 rigidly affixed to the motor frame 26. The housing 92 supports a sensing element 94 that includes an elastic element 96 received about the brake extension member 82. The outer portion 98 of the sensing element 94 is one electrode of a capacitor and the brake extension member 82 is the other electrode. The elastic element 96 establishes the dielectric properties of the sensing element.

In one example, the elastic element 96 includes a known polymer material that changes the capacitance of the sensor element 94 when a dimension of the polymer material changes. In the example shown, the polymer material changes dimension (e.g. the dimension D) in response to a load between the brake 36 and motor frame 26 when the brake 36 applies a braking force. The load is transferred through the brake extension member 82 to compress the elastic element 96. In one example, the load compresses the polymer material and the sensing elements 94 provide an indication of a change in electrical capacitance resulting from the polymer material compression. The change in electrical capacitance corresponds to the compressed dimension D of the polymer material in a known manner. The dimension D corresponds to the load on the polymer material via stress versus strain analysis as is known, for example. The controller 30 receives the capacitance and determines the load between the brake 36 and motor frame 26 based upon a predetermined correspondence between electrical capacitance and the load.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. An elevator machine assembly comprising:

a motor frame supporting at least a motor that selectively rotates a shaft;

a brake for selectively applying a braking force for preventing rotation of the shaft relative to the motor frame;

at least one load sensor that resists movement of the brake relative to the motor frame and provides an indication of a load resulting from applying the braking force; and at least one stop member arranged to stop rotation of the brake relative to the motor frame if the load exceeds a threshold of the load sensor.

2. The assembly as recited in claim 1, wherein the load sensor includes a load cell having a frame attachment portion attached directly to the motor frame and a brake attachment portion attached directly to the brake.

3. The assembly as recited in claim 1, wherein the load sensor includes a base and a load input portion, and the load sensor is positioned between the brake and the motor frame such that the load input portion receives the load.

4. The assembly as recited in claim 1, wherein the load sensor is positioned between corresponding surfaces on the brake and the motor frame such that the load sensor is subject to a compressive load during application of the braking force.

5. The assembly as recited in claim 4, when the load sensor is spaced a nominal distance from at least one of the corresponding surfaces.

6. The assembly as recited in claim 5, comprising a cushion material at least partially between the load sensor and the at least one surface.

7. The assembly as recited in claim 1, comprising a reaction member that cooperates with the load sensor to resist movement of the brake.

8. The assembly as recited in claim 7, wherein the reaction member resists radial movement of the brake relative to a longitudinal axis of the shaft.

9. The assembly as recited in claim 7, wherein the reaction member comprises a second load sensor that provides an indication of the load.

10. The assembly as recited in claim 7, wherein the reaction member is circumferentially spaced at least about 90° from a position of the load sensor with respect to a longitudinal axis of the shaft.

11. The assembly as recited in claim 7, wherein the reaction member comprises a cushion material that at least partially absorbs the load.

12. The assembly as recited in claim 1, wherein the at least one stop member includes a first locking member on the brake and a second locking member on the motor frame, and the first locking member interlocks with the second locking member with a circumferential spacing there between.

13. The assembly as recited in claim 1, wherein the at least one stop member includes a first locking member on the brake and a second locking member on the motor frame, and the first locking member and the second locking member have circumferential sides that abut one another if the load on the at least one load sensor exceeds the threshold.

14. The assembly as recited in claim 1, wherein the at least one load sensor is mounted between the motor frame and the brake.

15. An elevator machine assembly comprising:

a first member that resists movement of a braking member relative to a rigid member for a load between the braking member and the rigid member that is up to a threshold operating load of the first member; and a second member that is arranged to stop rotational movement of the braking member relative to the rigid member if the load is greater than the threshold operating load, wherein the second member includes a first locking member on the braking member and a second locking member on the rigid member, and the first locking member interlocks with the second locking member to stop rotational movement of the braking member relative to the rigid member if the load exceeds the threshold operating load and wherein the locking members are circumferentially spaced apart a nominal distance such that the braking member can move relative to the rigid member an amount corresponding to the nominal distance before the locking members cooperate to stop rotational movement.

16. The assembly as recited in claim 15, comprising a cushion material at least partially between the locking members for at least partially absorbing the load.

17. The assembly of claim 15, wherein the first member comprises a load sensor that provides an indication of the load between the braking member and the rigid member.

18. A method of measuring a load in an elevator assembly that includes an elevator machine having a motor supported by a motor frame, a shaft selectively driven by the motor, and a brake for selectively resisting rotation of the shaft comprising:

applying a braking force to the shaft that results in a load that urges the brake to move relative to the motor frame;

using a first resistive member to resist movement of the brake relative to the motor frame when the load is below a threshold load and to provide an indication of the load; and using a second resistive member to stop rotational movement of the brake relative to the motor frame when the load exceeds the threshold load, wherein the second resistive member includes a first locking member on the brake and a second locking member on the motor frame, and the first locking member and the second locking member have circumferential sides that abut one another to stop rotational movement when the load exceeds the threshold.

19. The method as recited in claim 18, wherein the first resistive member comprises a load sensor to provide the indication of the load.

20. The method as recited in claim 19, comprising determining a weight of an elevator cab based upon the indication of the load.

21. An elevator machine assembly comprising:

a first member that resists movement of a braking member relative to a rigid member for a load between the braking member and the rigid member that is up to a threshold operating load of the first member; and a second member that is arranged to stop rotational movement of the braking member relative to the rigid member if the load is greater than the threshold operating load, wherein the second member includes a first locking member on the braking member and a second locking member on the rigid member, and the first locking member interlocks with the second locking member with a circumferential spacing there between.

22. An elevator machine assembly comprising:

a first member that resists movement of a braking member relative to a rigid member for a load between the braking member and the rigid member that is up to a threshold operating load of the first member; and a second member that is arranged to stop rotational movement of the braking member relative to the rigid member if the load is greater than the threshold operating load, the second member includes a first locking member on the braking member and a second locking member on the rigid member, and the first locking member and the second locking member have circumferential sides that abut one another if the load exceeds the threshold.

* * * * *